US006100879A

United States Patent [19]

Da Costa

[11] Patent Number: 6,100,879

[45] Date of Patent: Aug. 8, 2000

[54] SYSTEM AND METHOD FOR CONTROLLING AN ACTIVE MATRIX DISPLAY

[75] Inventor: Victor M. Da Costa, Santa Cruz, Calif.

[73] Assignee: Silicon Image, Inc., Sunnyvale, Calif.

[21] Appl. No.: 08/909,022

[22] Filed: Aug. 11, 1997

Related U.S. Application Data

[60] Provisional application No. 60/025,070, Aug. 28, 1996.

[51] Int. Cl.[7] ..... G09G 5/00

[52] U.S. Cl. ..... 345/211; 345/98; 345/100; 345/212

[58] Field of Search ..... 345/88, 96, 98, 345/100, 204, 205, 206, 211, 212

[56] References Cited

U.S. PATENT DOCUMENTS

| | | | |
|---|---|---|---|
| 3,699,464 | 10/1972 | Zobel | 330/12 |
| 4,511,881 | 4/1985 | Adam | 340/347 |
| 4,748,444 | 5/1988 | Arai | 340/784 |
| 4,772,100 | 9/1988 | Suenaga | 350/336 |
| 4,838,654 | 6/1989 | Hamaguchi et al. | 350/333 |
| 4,868,459 | 9/1989 | Dennerlein et al. | 315/158 |
| 4,963,860 | 10/1990 | Stewart | 345/206 |
| 5,051,739 | 9/1991 | Hayashida et al. | 340/784 |
| 5,061,920 | 10/1991 | Nelson | 340/784 |
| 5,243,333 | 9/1993 | Shiba et al. | 345/100 |

(List continued on next page.)

FOREIGN PATENT DOCUMENTS

| | | | |
|---|---|---|---|
| 0 391 655 A2 | 10/1990 | European Pat. Off. | G09G 3/36 |
| 0 457 329 | 11/1991 | European Pat. Off. | G09G 3/36 |
| 0 720 140 A2 | 12/1995 | European Pat. Off. | G09G 3/36 |
| 44 46 330 A1 | 7/1995 | Germany | G09G 3/34 |
| 2 136 622 | 2/1984 | United Kingdom | G09G 3/20 |
| WO 96/18990 | 6/1996 | WIPO | G09G 3/36 |

OTHER PUBLICATIONS

H. Okada et al., "An 8–bit Digital Data Driver for AMLCDs", SID International Symposium Digest of Technical Papers, San Jose, Jun. 14–16 1994, vol. 25, pp. 347–350.

H. Tsuchi et al., *A New Digital Data–Line Circuit For TFT–LCD Driving,* May 12, 1996, NEC Corp., Kanagawa, Japan; SID In't Symposium Digest of Technical papers, San Diego, May 12–17, 1996, pp. 251–254.

Fluxman, S. M., "Integrated Active Matrix Liquid Crystal Displays", The GEC Journal of Research, vol. 11, No. 1, pp. 2–11, 1993.

Okada, H., Tanaka, K., Tamai, S., Tanaka, S., "23.1: An 8–bit Digital Data Driver for AMLCDs", SID 94 Digest, pp. 347–350, 1994.

Patent Cooperation Treaty International Preliminary Examination Report (PCT Article 36 and Rule 70) 6 pages.

*Primary Examiner*—Richard A. Hjerpe
*Assistant Examiner*—Henry N. Tran
*Attorney, Agent, or Firm*—Fenwick & West LLP

[57] ABSTRACT

A smart controller chip for controlling an active matrix display. Within the controller chip, circuitry for generating analog reference levels is incorporated alongside circuitry for generating digital timing and control signals. The combination of D/A analog circuitry and standard digital logic makes the controller uniquely suited for addressing all the panel control needs both for the normal digital functions but also for control of the analog aspects of the panel, like display gamma. The analog reference levels and the digital signals are made programmable using registers internal to the controller chip. The contents of these registers are programmed initially by digital values stored in an external PROM or in flash memory integrated into the controller chip. In addition, software in a host system is able to program these registers via an interface between the host system and the controller chip.

21 Claims, 10 Drawing Sheets

U.S. PATENT DOCUMENTS

| | | | |
|---|---|---|---|
| 5,250,931 | 10/1993 | Misawa et al. | 345/206 |
| 5,426,447 | 6/1995 | Lee | 345/103 |
| 5,436,745 | 7/1995 | Voisin et al. | 359/88 |
| 5,455,534 | 10/1995 | Motegi et al. | 327/544 |
| 5,485,173 | 1/1996 | Scheffer et al. | 345/100 |
| 5,510,748 | 4/1996 | Erhart et al. | 327/530 |
| 5,510,807 | 4/1996 | Lee et al. | 345/103 |
| 5,526,014 | 6/1996 | Shiba et al. | 345/96 |
| 5,546,102 | 8/1996 | Scheffer et al. | 345/100 |
| 5,572,211 | 11/1996 | Erhart et al. | 341/144 |
| 5,574,475 | 11/1996 | Callahan, Jr. et al. | 345/100 |
| 5,604,511 | 2/1997 | Ohi | 345/98 |
| 5,610,667 | 3/1997 | Hush | 348/796 |
| 5,623,277 | 4/1997 | Lippmann et al. | 345/87 |
| 5,650,801 | 7/1997 | Higashi | 345/210 |
| 5,675,352 | 10/1997 | Rich et al. | 345/89 |
| 5,693,237 | 12/1997 | Bodensohn | 216/23 |
| 5,726,676 | 3/1998 | Callahan, Jr. et al. | 345/98 |
| 5,734,364 | 3/1998 | Hirai et al. | 345/95 |
| 5,903,250 | 5/1999 | Lee et al. | 345/100 |

SYSTEM AND METHOD FOR CONTROLLING AN ACTIVE MATRIX DISPLAY

This application claims benefit of Provisional Application 60/025,070 filed Aug. 28, 1996.

I. BACKGROUND OF THE INVENTION

1. Technical Field

This invention relates to active matrix display controllers. An active matrix display controller is typically an application specific integrated circuit (ASIC) and is one of the support chips accompanying an active matrix flat panel display. The controller takes display data from the host system and provides it, along with control and timing signals, to the column and row drivers of the display panel.

2. Description of Related Art

With recent progress in various aspects of active matrix display technology, the proliferation of active matrix displays has been spectacular in the past several years. In an active matrix display, there is one transistor or switch corresponding to each display cell. An active matrix display is operated by first applying select voltages to a row electrode to activate the gates of that row of cells, and second applying appropriate analog data voltages to the column electrodes to charge each cell in the selected row to a desired voltage level.

To date the controller chips (integrated circuits) used in active matrix displays have been purely digital. However, controlling an active matrix display also requires analog circuitry. Specifically, the column drivers on the periphery of the display panel which supply the analog data voltages to the column electrodes typically need analog reference levels to do digital-to-analog conversion, and these analog reference levels may need to be changed to invert the polarity across the liquid crystal of the display. Because of the large size, power consumption, and heat generation of the analog circuitry, the analog circuitry is not incorporated in the purely digital controller chips of the prior art and must be handled with external circuitry. The presence of external circuitry increases the complexity of manufacturing and assembling the active matrix display system.

In addition, the controller chips to date are very specific to a particular system. The controller chips are typically designed for an active matrix display of a certain resolution and for peripheral drivers of certain manufacturers. The specificity of the design of the controller chips leads to problems and inefficiencies. For example, if a flat panel display manufacturer decides to switch to a different type of column driver, the controller ASIC (application specific integrated circuit) must usually be redesigned.

Furthermore, controller chips to date are rather limited in their ability to dynamically modify operating characteristics of a display. One such characteristic is the display gamma. The display gamma is the functional relationship defined by the amount of light emitted by the display cell, or pixel, as a function of the voltage used to produce it. In an active matrix display this voltage is the analog output of the column drivers. The gamma formula is Light_out= $voltage^{gamma}$. Typically display software assumes a linear gamma, that is the amount of light emitted is proportional to the voltage. However both CRTs and active matrix displays have inherent non-linearity in the light response to the voltage. In an active matrix display, the non-linear gamma is corrected by the analog reference levels sent to the column drivers.

If the ability to modify the display gamma exists, it is typically implemented with a color look-up table (CLUT) method which is rigid and inefficient. In a system using a CLUT, the digital value that will define the desired analog voltage, is actually used as an index to the CLUT. At each indexed location in the CLUT there is stored a new digital value. It is this value that, when converted to an analog voltage, gives the desired display gamma. Using color look-up tables to achieve non-linear display gammas results in a large number of digital values that correspond to the same transmission value. This is a large price to pay in flat panel displays where the digital values are typically limited to 6 bits (i.e. 64 levels). A more flexible and efficient method for modifying the display gamma is needed so that dynamic adjustments may be made in order to suit the display requirements of particular applications or to compensate for temperature changes which alter the transmission behavior of the display panel.

For the foregoing reasons, there is a need for a flat panel display controller that combines digital and analog circuitry to reduce the complexity of manufacturing and assembling the display system, that is flexible enough to apply to different systems without being redesigned, and that can dynamically modify operating characteristics of the display to suit particular applications and compensate for temperature changes which alter display panel transmission behavior.

II. SUMMARY

The present invention relates to a system and method for controlling an active matrix display that satisfies the above described needs. The system and method includes the use of a "smart" controller chip.

Analog circuitry for generating analog reference levels is incorporated alongside the digital circuitry within the smart controller chip. The combination of D/A analog circuitry and standard digital logic makes the controller uniquely suited for addressing all the panel control needs both for the normal digital functions but also for control of the analog aspects of the panel, like display gamma. Putting this analog control circuitry directly in a programmable control ASIC enables the analog functions of the panel to be controlled by software. Furthermore the elimination of the external reference circuitry reduces the complexity of manufacturing and assembling the display system.

In addition, the smart controller chip includes internal programmable registers that may contain digital values that correspond to analog reference levels. The contents of these registers may be programmed initially by digital values stored in an external PROM. This design enables the smart controller chip to be flexible enough to apply to different systems without being redesigned. Instead of having to redesign a controller ASIC for each specific display system, the same smart controller chip is used in conjunction with an appropriate PROM whose programming matches the specific display system. Alternatively, these registers may be programmed initially by digital values stored in flash memory integrated into the smart controller chip.

Software in the host system is also able to program the internal registers of the smart controller chip via an interface between the host system and the smart controller chip. By programming these registers with digital values which correspond to analog reference levels, the system software is able to dynamically modify operating characteristics of the display, such as the display gamma curve. Thus, dynamic adjustments may be made to suit particular applications being run on the host or to compensate for changes in the environment of the display panel.

This method of controlling the display gamma has substantial advantages over controlling the display gamma by the CLUT method. Whereas in the CLUT method a large number of digital values typically correspond to the same transmission value, in this method each of the digital values corresponds to a unique transmission value.

III. BRIEF DESCRIPTION OF THE DRAWINGS

IV. DESCRIPTION OF THE PREFERRED EMBODIMENTS

The preferred embodiments of the present invention are now described with reference to the figures.

Figure 1:
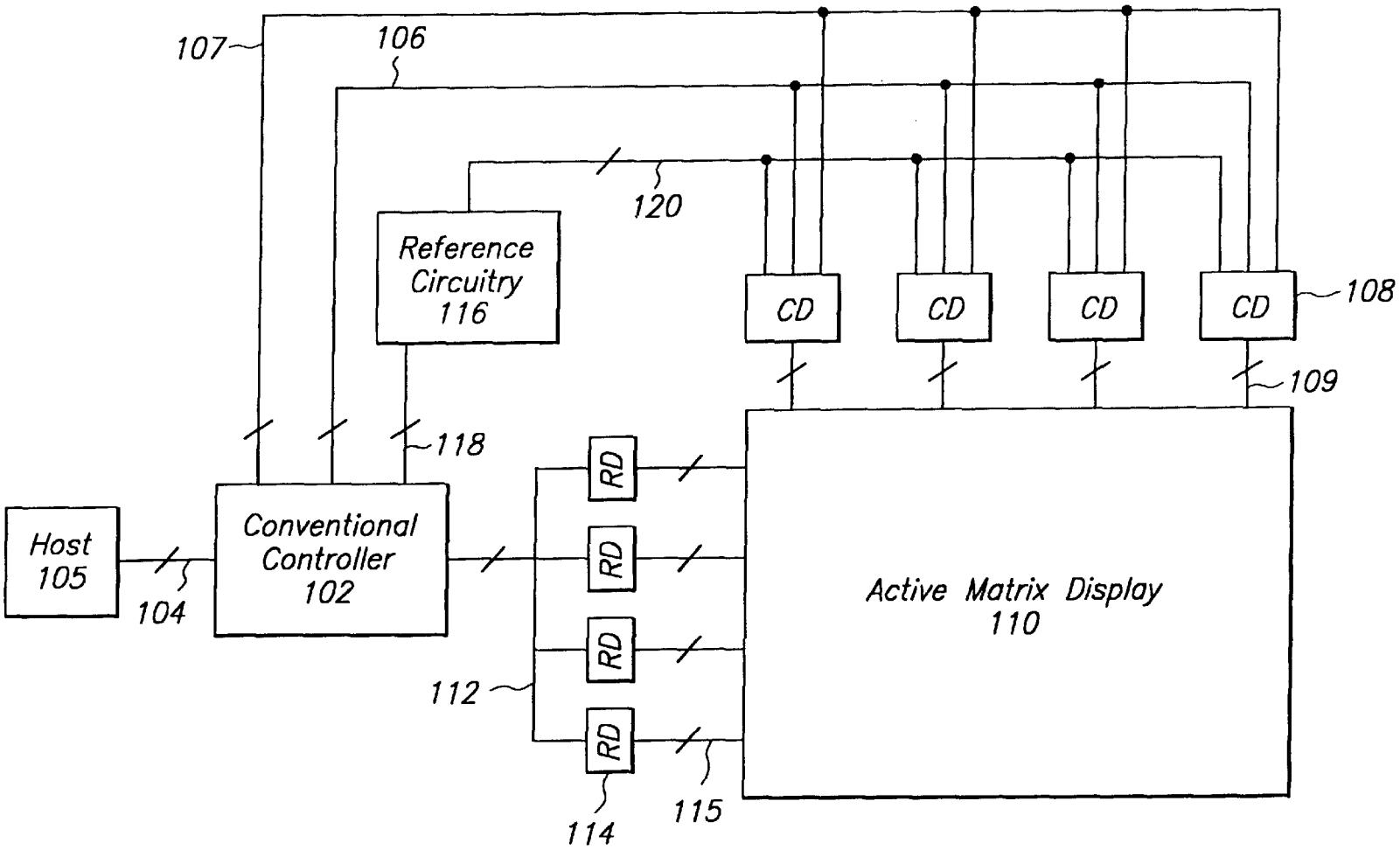
FIG. 1 (Prior Art)
FIG. 1 is a block diagram of a conventional control system for an active matrix display.

FIG. 1 is a block diagram of a conventional control system 100 for an active matrix display including a conventional controller chip 102. Display data and synchronization (sync) signals are input to the controller 102 via lines 104 from a host system 105 which is typically a computer system. The controller 102 sends the column control signals via lines 106 and display data via lines 107 to column drivers 108 which are connected via lines 109 to the column electrodes of an active matrix display 110. The controller 102 also sends row control signals via lines 112 to row drivers 114 which are connected via lines 115 to the row electrodes of the active matrix display 110. External to the controller 102. There is reference circuitry 116 which receives reference control signals via lines 118 from the controller 102 and sends analog reference levels via lines 120 to the column drivers 108. When the column drivers 108 are low-voltage column drivers, then the reference circuitry 116 may also switch the analog reference levels between two fixed voltage levels in order to invert the polarity of the liquid crystal in the display 110. The liquid crystal (LC) material requires that the voltage applied across it switch in polarity over time, otherwise there will be image quality problems with the liquid crystal material. This is called LC inversion. The LC material is sandwiched between two plates of a capacitor. One plate is connected by a matrix switch to the outputs of the column drivers. The other plate is common between all the capacitors of the matrix. This common potential is typically called VCOM. High voltage column drivers have sufficient voltage range on their outputs that they can switch the polarity of the liquid crystal from voltages positive with reference to VCOM to voltages that are negative referenced to VCOM. These high voltage drives also have enough analog reference levels that both the positive and negative voltage levels are input to the column driver. Therefore the column driver itself can handle all the aspects of the LC inversion. When low voltage column drivers are used, the polarity across the LC material can only be switched if the VCOM potential is also switched. In this case, the column driver only takes one set of reference levels on its input. To drive a positive polarity, VCOM is switched to a lower voltage than the column outputs and the positive reference levels must be input to the column driver. To drive negative polarity VCOM must be switched higher than the column outputs and negative reference levels must be input to the column driver.

Figure 2:
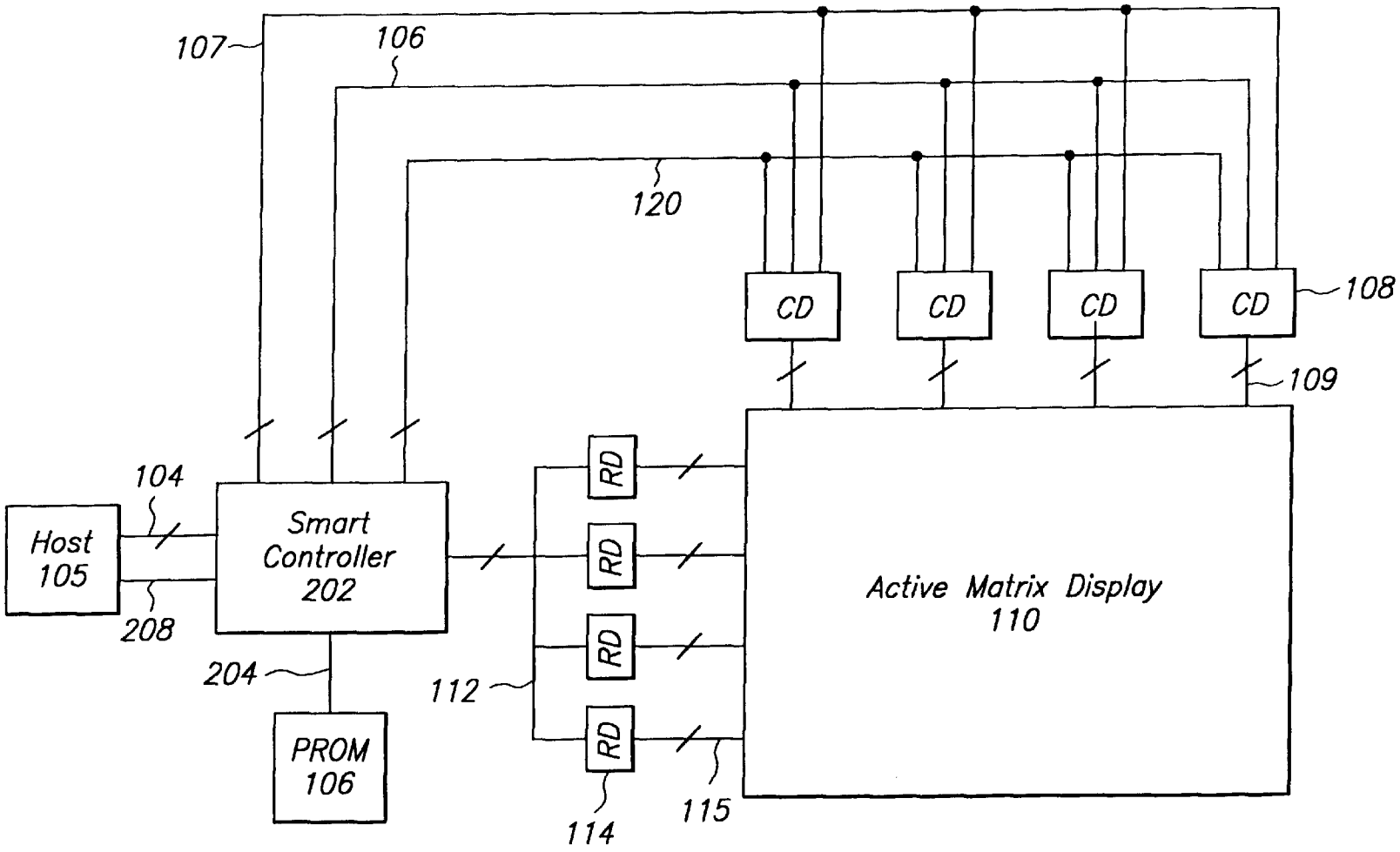
FIG. 2 is a block diagram of a first display control system including a smart controller outputting relatively high-power analog reference levels in a first and preferred embodiment of the present invention.

FIG. 2 is a block diagram of a first and preferred display control system 200. The first display control system 200 includes a first "smart" controller chip 202, a first serial bus 204, a programmable read-only memory (PROM) chip 206, and a second serial bus 208.

Display data and sync signals are input to the first smart controller 202 via lines 104 from a host system 105 which may be a computer system or another machine such as a television or video system. The first smart controller 202 sends the column control signals via lines 106 and display data via lines 107 to the column drivers 108 which are connected via lines 109 to the column electrodes of the display 110. The display 110 may be an active matrix display or another similarly driven display. The first smart controller 202 also sends row control signals via lines 112 to row drivers 114 which are connected via lines 115 to the row electrodes of the display 110.

The first smart controller 202 in this system 200 drives relatively high-power programmable analog reference levels via lines 120 to the column drivers 108 without using the external reference circuitry 116 which is required in the conventional system 100. The elimination of the external reference circuitry 116 reduces the complexity of manufacturing and assembling the active matrix display system.

In addition, the relatively high-power analog reference levels and the column and row control signals which are output by the first smart controller 202 are programmed initially via the first serial bus 204 by the external PROM 206. A typical industry standard serial bus and protocol which may be used for first serial bus 204 is the $I^2C$ bus. The programmability of the outputs of the first smart controller 202 by the external PROM 206 gives the first smart controller 202 the flexibility to work in different display systems without being redesigned for the characteristics of each specific one.

Furthermore, the second serial bus 208 is used to communicate information between the first smart controller 202 and the host system 105. Using this communication channel, software in the host system 105 is able to dynamically modify the analog reference levels and the column and row control signals output by the first smart controller 202. Note that the first and the second serial buses (204 and 208) need not be separate buses and can instead be the same bus. The ability of the first smart controller 202 to dynamically modify its outputs enables it to adjust operating characteristics of the display to suit particular applications and compensate for environmental changes.

Figure 3A:
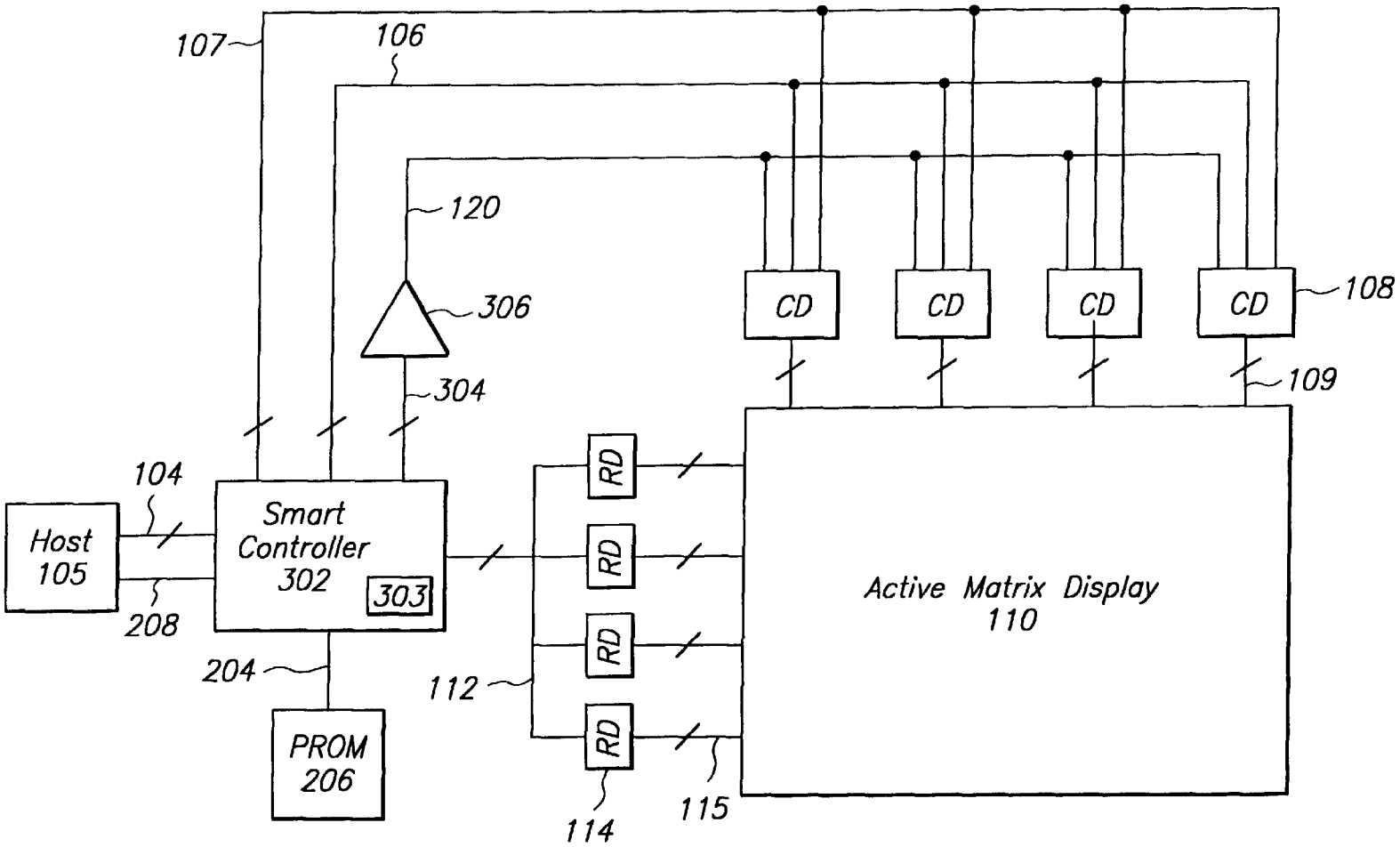
FIG. 3A is a block diagram of a second display control system including a smart controller outputting relatively low-power analog reference levels and buffers external to the smart controller in a second and alternate embodiment of the present invention.

FIG. 3A is a block diagram of a second and alternate display control system 300. The second display control system 300 includes a second smart controller chip 302 and drive buffers 306.

Like in the first display control system 200, display data and sync signals are input via lines 104 to the second smart controller 302 from the host system 105 which may be a computer system or another machine such as a television or video system. The second smart controller 302 sends column control signals via lines 106 and display data via lines 107 to the column drivers 108 which are connected via lines 109 to the column electrodes of the display 110. The display 110 may be an active matrix display or another similarly driven display. The smart controller 302 also sends row control signals on lines 112 to row drivers 114 which are connected via lines 115 to the row electrodes of the display 110.

Also like in the first display control system 200, the column and row control signals which are output-by the second smart controller 302 are programmed initially via the first serial bus 204 by the PROM 206 which is external to the second smart controller 302. A typical industry standard serial bus and protocol which may be used for the first serial bus 204 is the $I^2C$ bus. Alternatively, the initial programming may be supplied by flash memory 303 integrated into the second smart controller 302 (in which case the external PROM 206 would not be necessary).

Further like in the first display control system 200, the second serial bus 208 is used to communicate information between the second smart controller 302 and the host system 105. Using this communication channel, software in the host system 105 is able to dynamically modify the column and row control signals output by the smart controller 302. Note again that the first and the second serial buses (204 and 208) need not be separate buses and can instead be the same bus.

Unlike in the first display control system 200, the external drive buffers 306 are required in the second display control system 300 to drive relatively high-power analog reference levels on lines 120 to the column drivers 108. The second smart controller 302 outputs relatively low-power analog reference levels via lines 304 to the external drive buffers 306. The external drive buffers 306 receive the low-power analog reference levels and drive the high-power analog reference levels on lines 120 to the column drivers 108. Like the first display control system 200, the second display control system 300 has lower cost and complexity than the conventional display system 100 and outputs analog reference levels that are programmable by the controller 302 or the host system 105. An advantage of the second display control system 300 over the first display control system 200 is that the external buffers 306 may be readily changed in order to match their drive capability to the drive requirements of the particular column drivers 108 used.

Figure 3B:
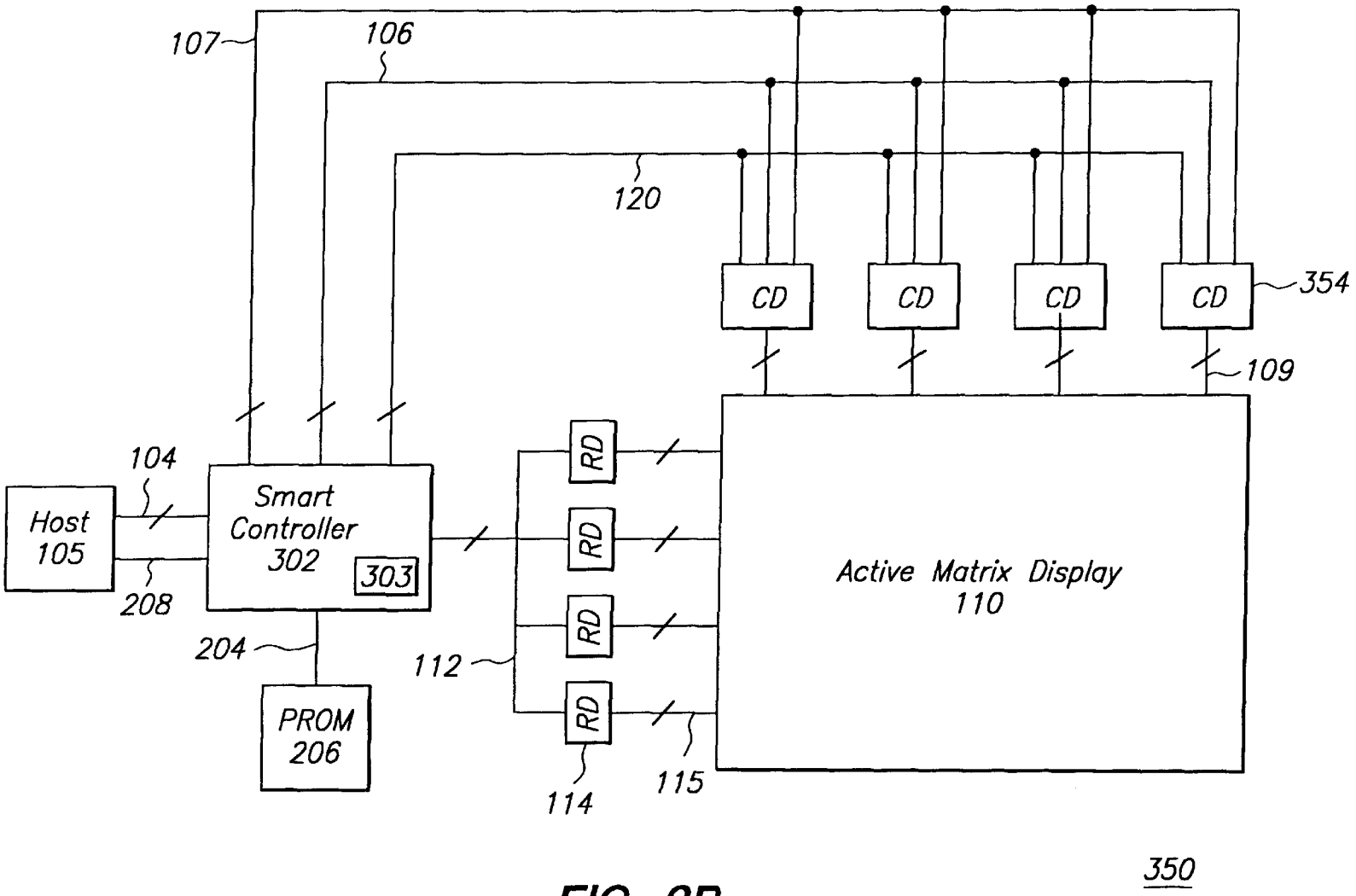
FIG. 3B is a block diagram of a third display control system including a smart controller outputting relatively low-power analog reference levels and column drivers capable of utilizing the relatively low-power analog reference levels in a third and alternate embodiment of the present invention.

FIG. 3B is a block diagram of a third and alternate display control system 350. The third display control system 350 includes the second smart controller chip 302 and column drivers 354 that require only relatively low-power analog reference levels.

As in the second display control system 300, display data and sync signals are input via lines 104 to the second smart controller 302 from the host system 105 which may be a computer system or another machine such as a television or video system. The second smart controller 302 sends column control signals via lines 106 and display data via lines 107 to the column drivers 108 which are connected via lines 109 to the column electrodes of the display 110. The display 110 may be an active matrix display or another similarly driven display. The smart controller 302 also sends row control signals on lines 112 to row drivers 114 which are connected via lines 115 to the row electrodes of the display 110.

Also as in the second display control system 300, the column and row control signals which are output by the second smart controller 302 are programmed initially via the first serial bus 204 by the PROM 206 which is external to the second smart controller 302. A typical industry standard serial bus and protocol which may be used for the first serial bus 204 is the $I^2C$ bus. Alternatively, these registers may be programmed initially by flash memory 303 integrated into the smart controller chip (in which case the PROM 206 would not be necessary).

Further as in the second display control system 300, the second serial bus 208 is used to communicate information between the second smart controller 302 and the host system 105. Using this communication channel, software in the host system 105 is able to dynamically modify the column and row control signals output by the smart controller 302. Note again that the first and the second serial buses (204 and 208) need not be separate buses and can instead be the same bus.

Unlike in the second display control system 300, the external drive buffers 306 are not required to drive relatively high-power analog reference levels on lines 120 to the column drivers 108. Instead, the second smart controller 302 outputs relatively low-power analog reference levels directly via lines 120 to the column drivers 354 which are capable of utilizing the low-power analog reference levels.

Figure 4A:
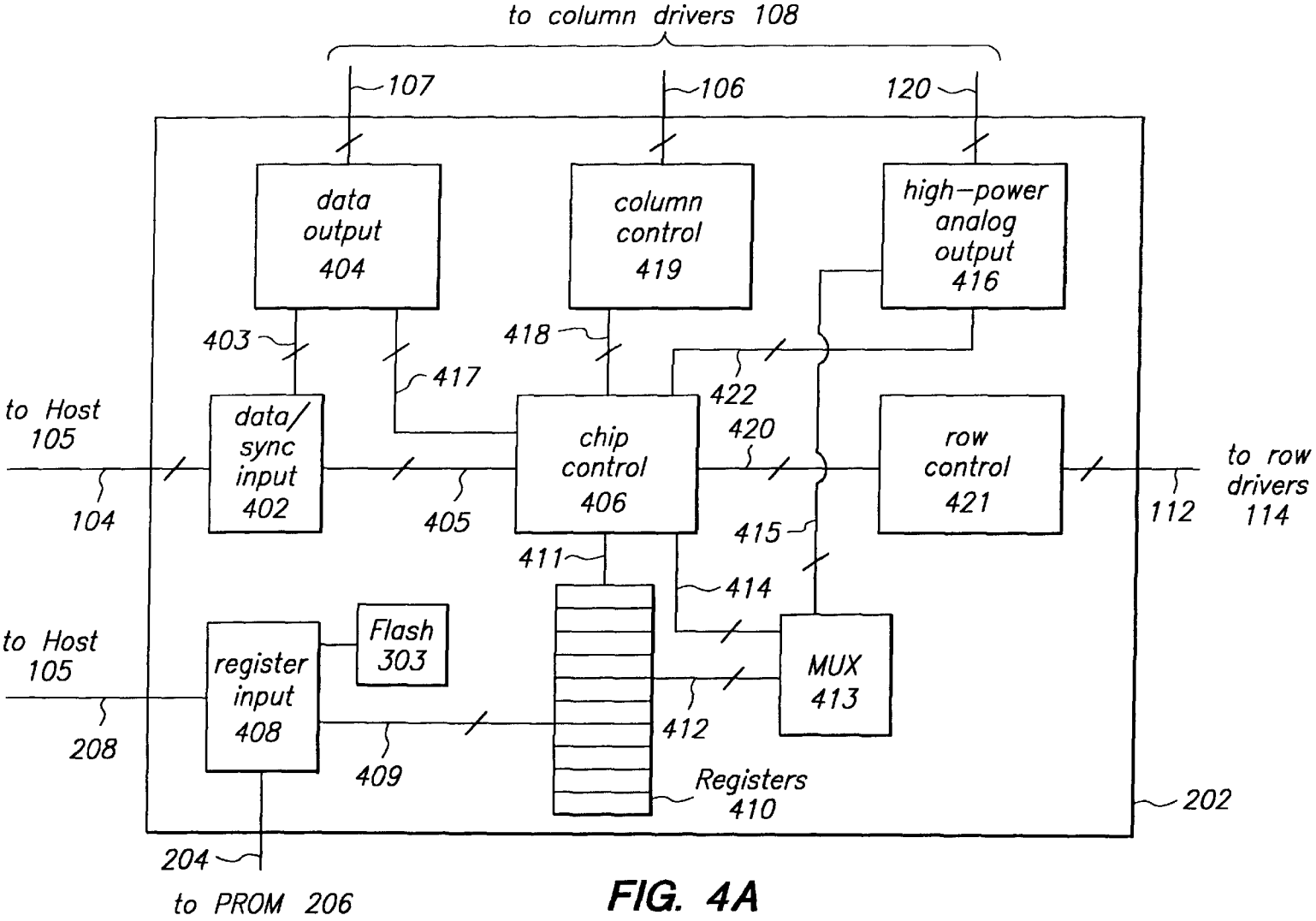
FIG. 4A is a block diagram of a first smart controller chip in a first and preferred embodiment of the present invention.

FIG. 4A is a block diagram showing a more detailed view of the first smart controller 202 which is embedded in the first display control system 200. The first smart controller 202 includes data/sync input circuitry 402, data output circuitry 404, chip control circuitry 406, register input circuitry 408, programmable registers 410, multiplexer circuitry 412, column control circuitry 419, row control circuitry 421, high-power analog output circuitry 416, and optionally flash memory 303.

Data/sync input circuitry 402 receives display data and sync signals via lines 104 from the host system 105. The data/sync input circuitry 402 is connected via lines 403 to data output circuitry 404 and via lines 405 to the chip control circuitry 406.

Register input circuitry 408 may receive digital values via the first serial bus 204 from the external PROM 206 and via the second serial bus 208 from the host system 105. The register input circuitry 408 is connected via lines 409 to the registers 410. Alternatively, the register input circuitry 408 may receive digital values from the flash memory 303.

The registers 410 are connected via lines 411 to the chip control circuitry 406. The registers 410 are also connected via lines 412 to multiplexer (MUX) circuitry 413 which is in turn connected via lines 414 to the chip control circuitry 406 and via lines 415 to the high-power analog output circuitry 416.

The chip control circuitry 406 receives information via lines 405 from the data/sync input circuitry 402 and via lines 411 from the programmable registers 410. Using the information thus received, the chip control circuitry 406 sends timing and control signals via lines 417 to the data output circuitry 404, via lines 418 to the column control circuitry 419, via lines 420 to the row control circuitry 421, and finally via lines 422 to the high-power analog output circuitry 416.

The data output circuitry 404 receives display data signals via lines 403 from the data/sync input circuitry 402 and timing and control signals via lines 417 from the chip control circuitry 406. The data output circuitry 404 sends the display data signals via lines 107 to the column drivers 108.

The column control circuitry 419 receives timing and control signals via lines 418 from the chip control circuitry 406. The column control circuitry 419 sends timing and control signals via lines 106 to the column drivers 108.

The row control circuitry 421 receives timing and control signals via lines 420 from the chip control circuitry 406. The row control circuitry 421 sends timing and control signals via lines 112 to the row drivers 114.

Finally, the high-power analog output circuitry 416 receives timing and control signals via lines 422 from the chip control circuitry 406 and digital values via lines 415 from the MUX circuitry 413. The high-power analog output circuitry 416 sends relatively high-power analog reference levels via lines 120 to the column drivers 108.

Figure 4B:
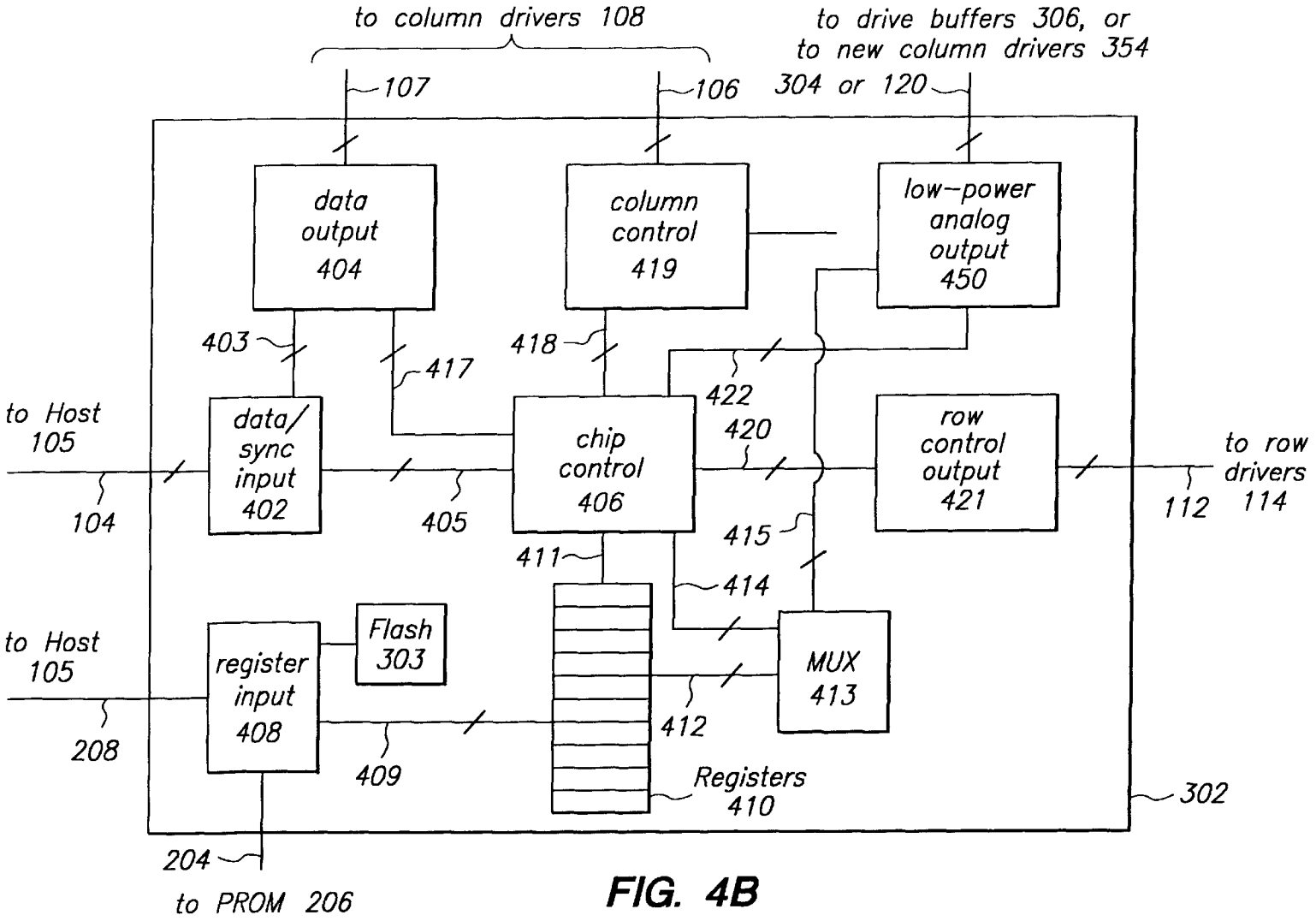
FIG. 4B is a block diagram of a second smart controller chip in a second and alternate embodiment of the present invention.

FIG. 4B is a block diagram showing a more detailed view of the second smart controller 302 which is embedded either in the second display control system 300 or the third display control system 350. Like the first smart controller 202, the second smart controller 302 includes data/sync input circuitry 402, data output circuitry 404, chip control circuitry 406, register input circuitry 408, programmable registers 410, multiplexer circuitry 412, column control circuitry 419, and row control circuitry 421. Unlike the first smart controller 202, the second smart controller 302 includes low-power analog output circuitry 450.

Data/sync input circuitry 402 receives display data and sync signals via lines 104 from the host system 105. The data/sync input circuitry 402 is connected via lines 403 to data output circuitry 404 and via lines 405 to the chip control circuitry 406.

Register input circuitry 408 may receive digital values via the first serial bus 204 from the external PROM 206 and via the second serial bus 208 from the host system 105. The register input circuitry 408 is connected via lines 409 to the registers 410. Alternatively, the register input circuitry 408 may receive digital values from the flash memory 303.

The registers 410 are connected via lines 411 to the chip control circuitry 406. The registers 410 are also connected via lines 412 to multiplexer (MUX) circuitry 413 which is in turn connected via lines 414 to the chip control circuitry 406 and via lines 415 to the low-power analog output circuitry 450.

The chip control circuitry 406 receives information via lines 405 from the data/sync input circuitry 402 and via lines 411 from the programmable registers 410. Using the information thus received, the chip control circuitry 406 sends timing and control signals via lines 417 to the data output circuitry 404, via lines 418 to the column control circuitry 419, via lines 420 to the row control circuitry 421, and finally via lines 422 to the low-power analog output circuitry 450.

The data output circuitry 404 receives display data signals via lines 403 from the data/sync input circuitry 402 and timing and control signals via lines 417 from the chip control circuitry 406. The data output circuitry 404 sends the display data signals via lines 107 to the column drivers 108.

The column control circuitry 419 receives timing and control signals via lines 418 from the chip control circuitry 406. The column control circuitry 419 sends timing and control signals via lines 106 to the column drivers 108.

The row control circuitry 421 receives timing and control signals via lines 420 from the chip control circuitry 406. The row control circuitry 421 sends timing and control signals via lines 112 to the row drivers 114.

Finally, the low-power analog output circuitry 450 receives timing and control signals via lines 422 from the chip control circuitry 406 and digital values via lines 415 from the MUX circuitry 413. If the second smart controller 302 is used in the second display control system 300, the low-power analog output circuitry 416 sends low-power analog reference levels via lines 304 to the drive buffers 306. If the second smart controller 302 is used in the third display control system 350, the low-power analog output circuitry 416 sends low-power analog reference levels via lines 120 to the column drivers 354 which are capable of utilizing low-power analog reference levels.

Figure 5:
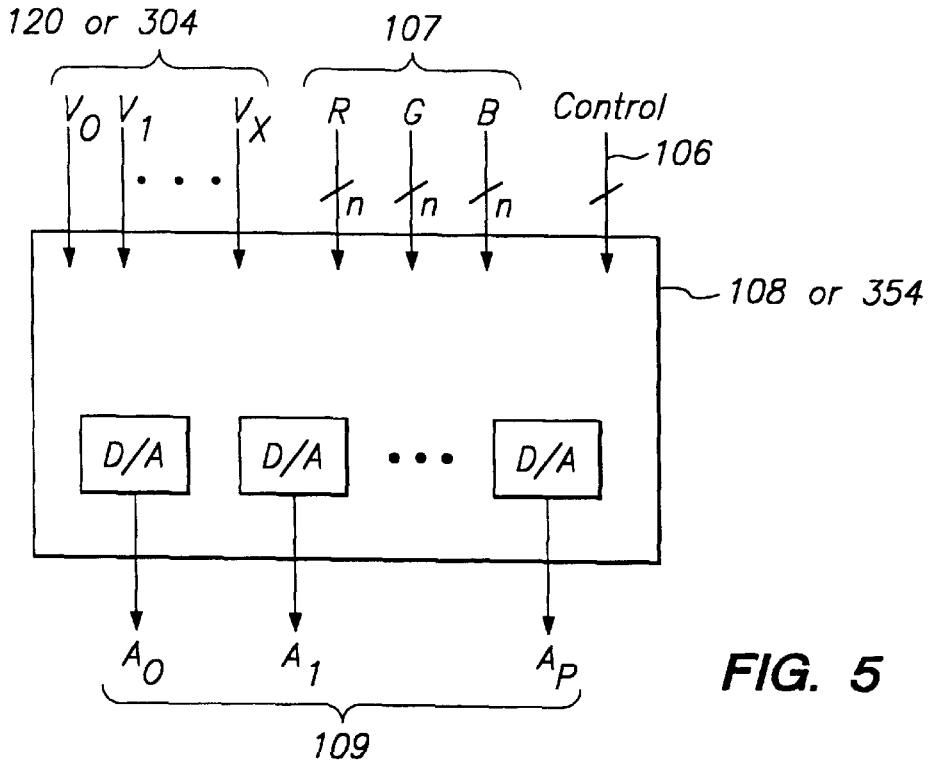
FIG. 5 is a schematic diagram of the inputs and outputs of a conventional column driver.

FIG. 5 is a schematic diagram showing the input/output of a column driver (108 or 354). The column driver (108 or 354) receives as input X+1 analog reference levels (V0, V1, . . . , VX) (either high-power or low-power) via lines (120 or 304), digital display data via lines 107, and control and timing signals via lines 106. The column driver (108 or 354) outputs a large number (p+1) of analog voltages that are applied via lines 109 to the column electrodes of the display 110. Each of the n-bit display data values is latched and converted using the X+1 analog reference levels to one of the p+1 analog voltages. In the conversion process the X+1 analog reference levels are typically used to approximate a non-linear transfer curve 602 of a liquid crystal display (LCD).

Figure 6:
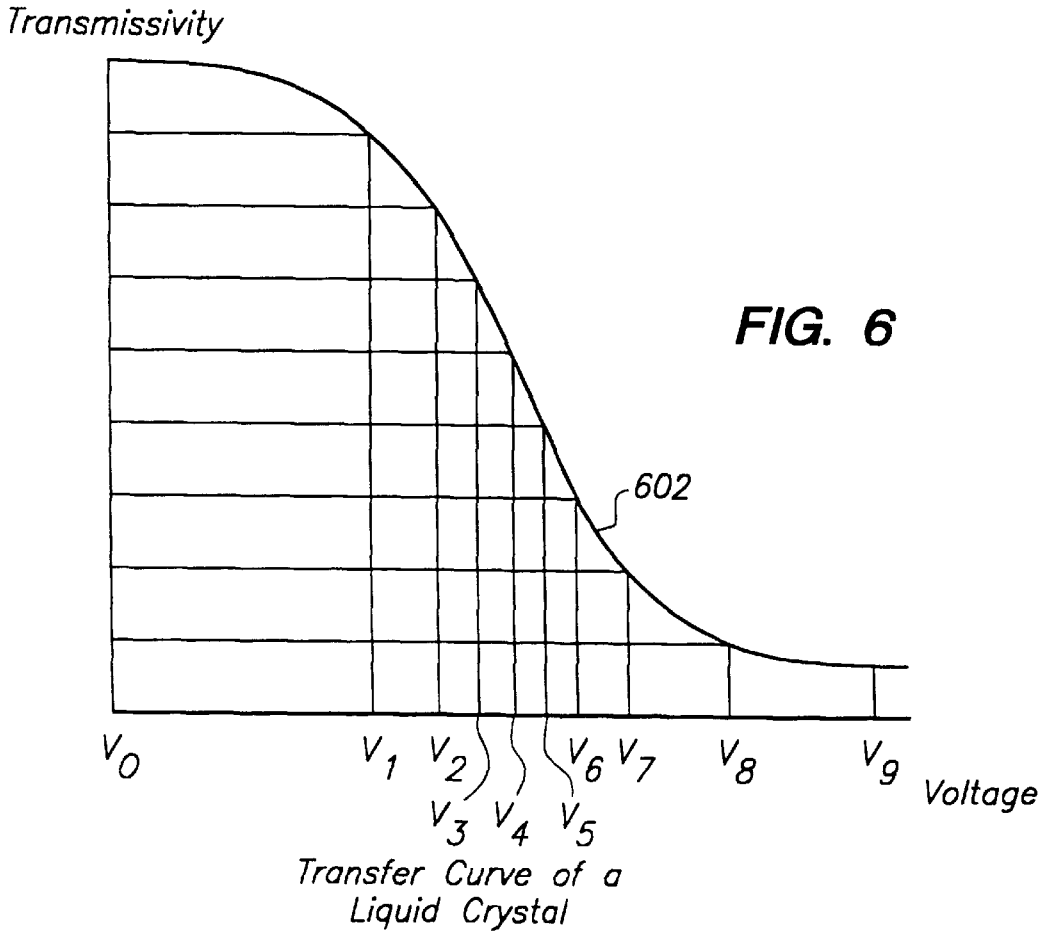
FIG. 6 is a graph of a transfer curve of a liquid crystal.

FIG. 6 is a graph of a typical non-linear LCD transfer curve 602. Transmission of a display pixel is plotted against voltage applied across the pixel. For purposes of illustration ten reference voltages, V0 through V9 (X=9), are shown that correspond to linear steps in transmission. These reference voltages are the analog reference levels used by the column drivers (108 or 354) to convert the n-bit data values to the analog voltages that are applied via lines 109 to the column electrodes of the display 110.

Figure 7A:
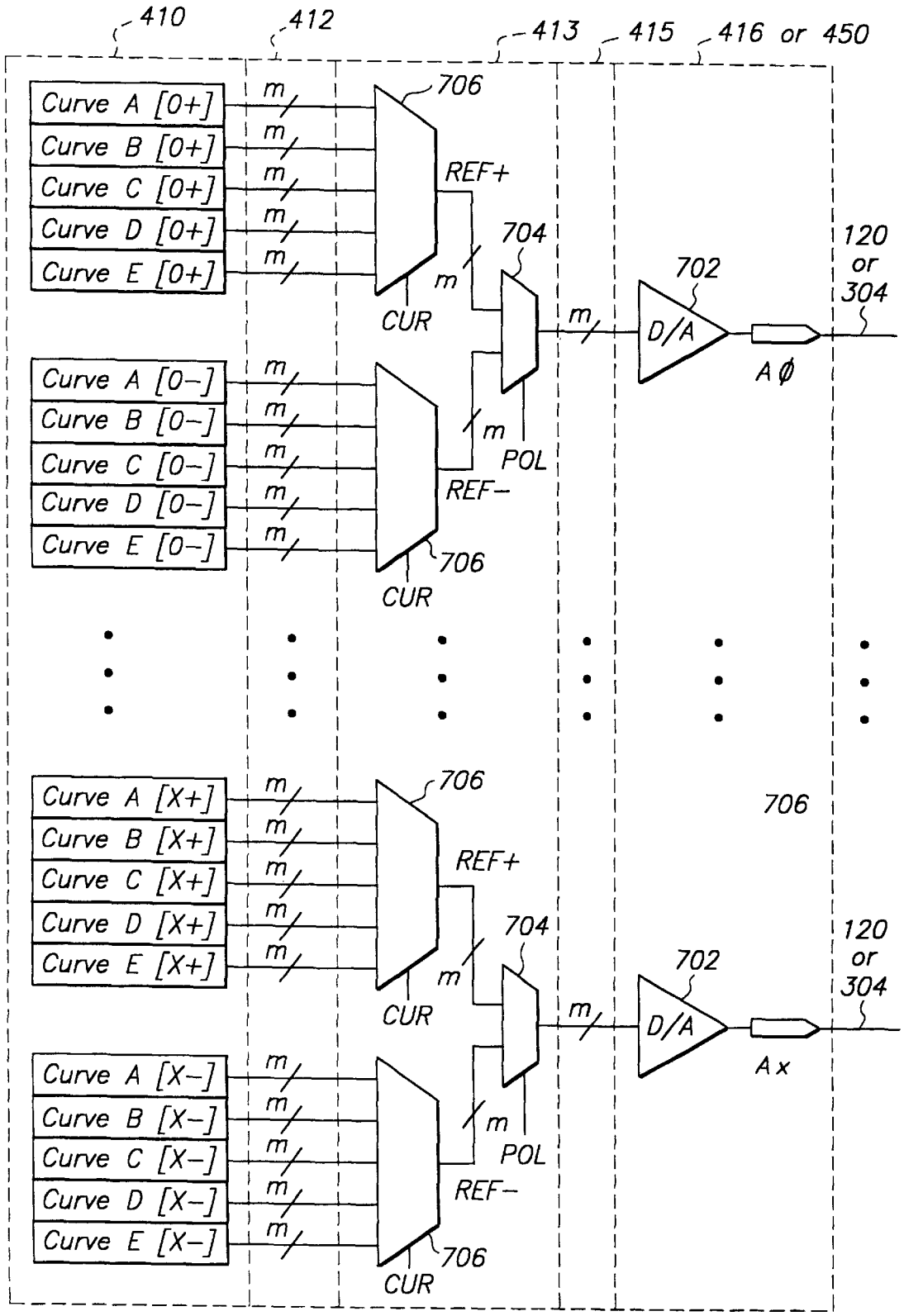
FIG. 7A is a block diagram including registers, multiplexers, and analog output circuitry within a smart controller in a first and preferred embodiment of the present invention.

FIG. 7A is a diagram of a first and preferred embodiment 700 including either the high-power analog output circuitry 416 in FIG. 4A or the low-power analog output circuitry 450 in FIG. 4B. This first embodiment requires that the size of the D/A converters 702 is small enough for several of them to be easily integrated onto the smart controller chip (202 or 302).

As shown in FIG. 7A, X+1 internal digital-to-analog (D/A) converters 702 output analog reference levels (A0, A1, . . . , AX). For low-power analog output circuitry 450, the outputs of the D/A converters 702 are relatively low power. For high-power analog output circuitry 416, the outputs of the D/A converters 702 must be higher power.

The D/A converters 702 receive their input via lines 415 from the X+1 2:1 multiplexers 704 in MUX circuitry 413. Each 2:1 multiplexer 704 is controlled by a polarity (POL) signal and selects between either of two reference values, REF+ or REF−. The POL signal is received by the MUX circuitry 413 via lines 414 from the chip control circuitry 406.

Each of these reference values, REF+ and REF−, is selected via lines 412 from among multiple digital values stored in one of 2(X+1) register files in programmable registers 410. The selection from among the multiple digital values in each register file may be performed by various means. For example, as shown in FIG. 7A, 2(X+1) 5:1 multiplexers 706 may be used where five is the number of digital values stored in each register file. These 5:1 multiplexers 706 are controlled by a curve selection (CUR) signal that is received via lines 414 from the chip control circuitry 406.

Each of the digital values in a register file may correspond to a different transfer curve. Thus taken as a whole, the register files allow the smart controller (202 or 302) to store multiple transfer curves, denoted by curve A, curve B, curve C, etc.

As illustrated in FIG. 7A, two versions of each transfer curve, denoted by plus and minus signs, may be stored in two associated register files. The 2:1 MUXes 704 select whether the plus or the minus version of the transfer curve is used as the input to the D/A converters 702 depending on the value of the POL signal. The POL signal may be caused by the chip control circuitry 406 to switch between the plus or minus versions of the transfer curve at any point during a display line time, or to fix the selected reference value to the plus or minus version of the transfer curve. One use of switching between the plus and minus versions of a transfer curve is to invert the polarity of the LC (liquid crystal) material between the addressing of the rows.

The analog outputs of the D/A converters 702 should be of a resolution high enough to properly compensate for the non-linearity of the transfer curve of the liquid crystal. That is, the digital values in the register files should have a sufficient number of bits so that the analog outputs of the D/A converters 702 may be adjusted to greater precision than the precision of the output of the column drivers (108 or 354). Modern column drivers have precisions typically on the order of 20 mV. The voltage range necessary nowadays for the analog outputs is about 10V because the full transfer curve (both positive and negative) of the liquid crystal must be spanned. For the case where the D/A converters 702 convert digital values to analog values linearly, the digital values must have at least 9 bits of precision because 10V/20 mV=500 and $2^9$=512. In FIG. 7A, the number of bits for each of the digital values is m. Thus, using the above calculations, m should be at least 9. If non-linear D/A converters 702 are used, then the number of bits may be reduced by concentrating the highest analog precision to the sections of the transfer curve where the transmission changes rapidly with voltage, and by allowing greater error tolerances on the sections of the transfer curve where the transmission changes less rapidly.

Figure 7B:
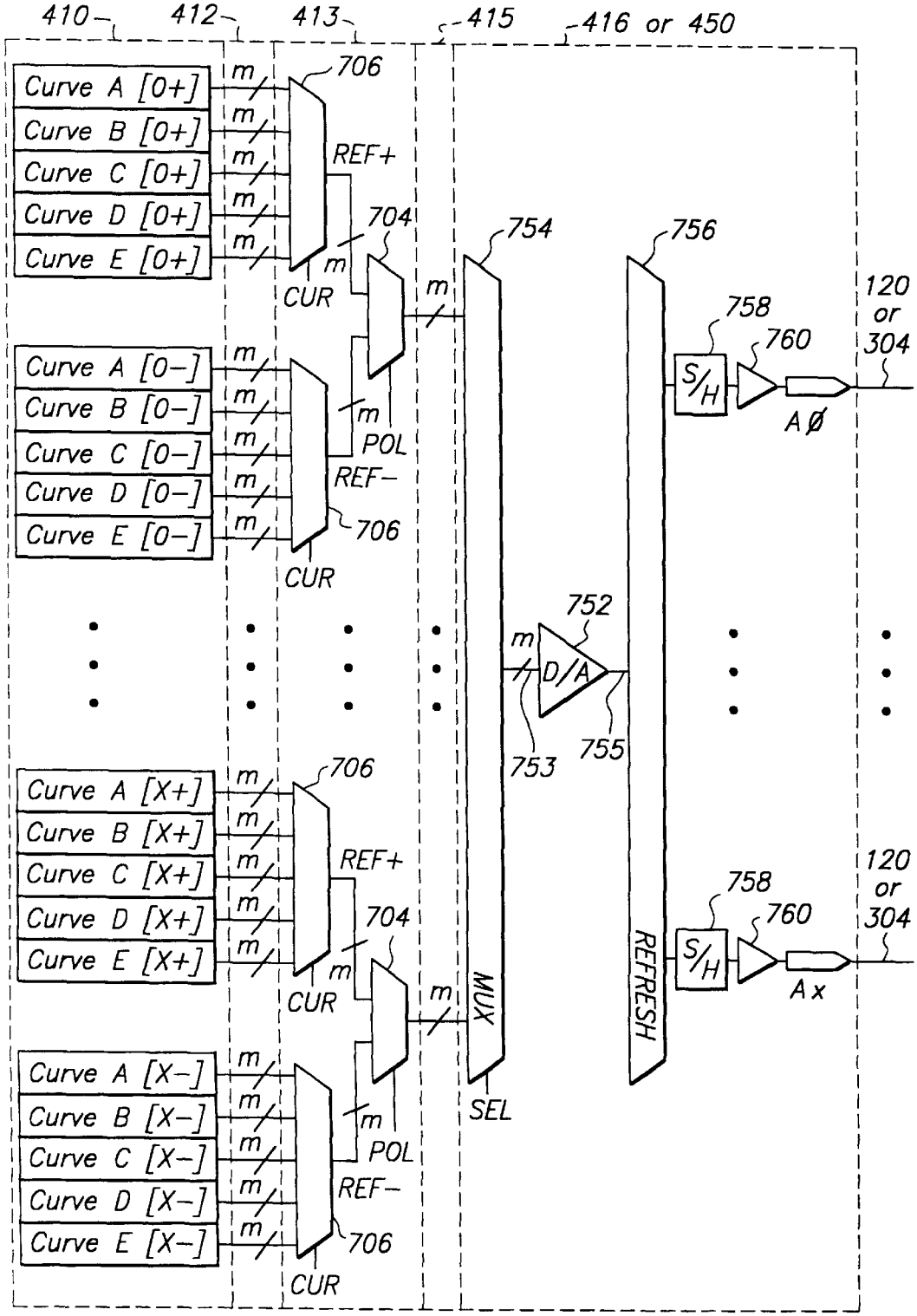
FIG. 7B is a block diagram including registers, multiplexers, and analog output circuitry within a smart controller in a second and alternate embodiment of the present invention.

FIG. 7B is a diagram of a second and alternate embodiment including either the high-power analog output circuitry 416 in FIG. 4A or the low-power analog output circuitry 450 in FIG. 4B. This second embodiment is preferable if the size of a D/A converter 702 is too large for several of them to be easily integrated onto the smart controller chip (202 or 302).

Unlike in the first embodiment 700, in the second embodiment 750 a single D/A converter 752 is used to drive all of the X+1 analog reference levels (A0, A1, . . . AX). The input into the D/A converter 752 comes from (X+1): 1 MUX 754. The (X+1): 1 MUX 754 selects one of the X+1 digital reference values output by the 2:1 MUXes 704. The (X+1):1 MUX 754 is controlled by a selection (SEL) signal that is received via lines 414 from the chip control circuitry 406.

Each analog output of the D/A converter 752 is fed by a refresh circuit 756 into a particular one of X+1 sample and hold (S/H) circuits 758. The particular S/H circuit 758 into which the analog output is fed corresponds to the digital reference value selected by the (X+1):1 MUX 754. Since S/H circuits 758 typically use dynamic storage, the refresh circuit 756 must continually run to refresh the stored analog values in the S/H circuits 758. At the output of each S/H circuit 758 is a buffer 760 to boost the drive capability of the analog reference level which is output. For high-power analog output circuitry 416, the buffers 760 must be of relatively high power. For low-power analog output circuitry 450, the buffers 760 may be relatively low power.

Like in the first embodiment 700, in the second embodiment 750 each of the 2:1 MUXes 704 selects between either of two reference values, REF+ or REF−. Each of these reference values is selected from among multiple digital values stored in one of a pair of register files in registers 410. The selection from among the multiple digital values in each register file may be performed by various means. For example, in FIG. 7B 5:1 multiplexers 706 are used.

Also like in the first embodiment 700, in the second embodiment 750 each of the multiple digital values in a register file may correspond to a different transfer curve. Thus, taken as a whole, the register files allow the smart controller (202 or 302) to store multiple transfer curves, denoted by curve A, curve B, curve C, etc. For example, in FIG. 7B the total number of transfer curves shown is five.

Again like in the first embodiment 700, in the second embodiment 750 the smart controller (202 or 302) stores two versions of each transfer curve in two associated register files. The plus and minus signs denote the two different versions. The 2:1 MUXes 704 select whether the plus or the minus version of the transfer curve is used as the input to the (X+1):1 MUX 754. The 2:1 MUXes 704 are controlled by the internal polarity (POL) signal which is received via lines 414 from the chip control circuitry 406. The POL signal may be programmed to cause the 2:1 MUXes 704 to switch between the REF+ and the REF− reference values at any point during a display line time, or to fix the selected reference value to the plus or minus version of the transfer curve.

Finally, like in the first embodiment 700, the analog reference levels (A0, A1, . . . , AX) should be of sufficiently high resolution in order to be able to properly compensate for the non-linearity of the transfer curve of the liquid crystal. That is, the digital values in the register files should have a sufficient number of bits so that the analog outputs of the D/A converters 702 may be adjusted to greater precision than the precision of the output of the column drivers (108 or 354). Modern column drivers have precisions typically on the order of 20 mV. The voltage range necessary nowadays for the analog outputs is about 10V because the full transfer curve (both positive and negative) of the liquid crystal must be spanned. For the case where the D/A converters 702 convert digital values to analog values linearly, the digital values must have at least 9 bits of precision because 10V/20 mV=500 and $2^9$=512. In FIG. 7B, the number of bits for each of the digital values is m. Thus, using the above calculations, m should be at least 9. If non-linear D/A converters 702 are used, then the number of bits may be reduced by concentrating the highest analog precision to the sections of the transfer curve where the transmission changes rapidly with voltage, and by allowing greater error tolerances on the sections of the transfer curve where the transmission changes less rapidly.

Figure 8A:
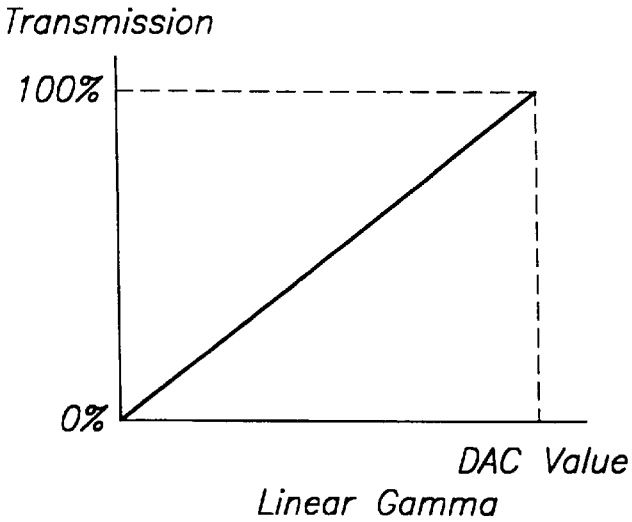
FIG. 8A is a graph of a linear display gamma.
Figure 8B:
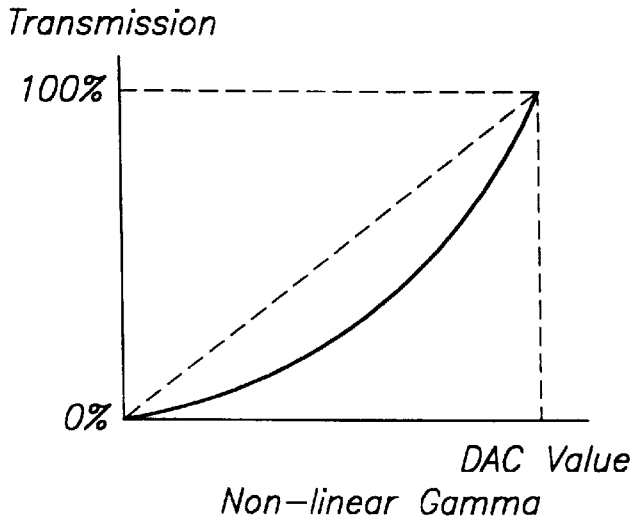
FIG. 8B is a graph of a first non-linear display gamma.
Figure 8C:
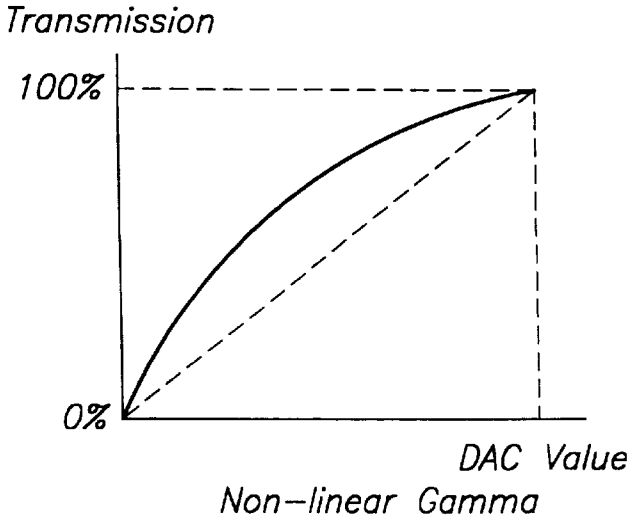
FIG. 8C is a graph of a second non-linear display gamma.
Figure 2:
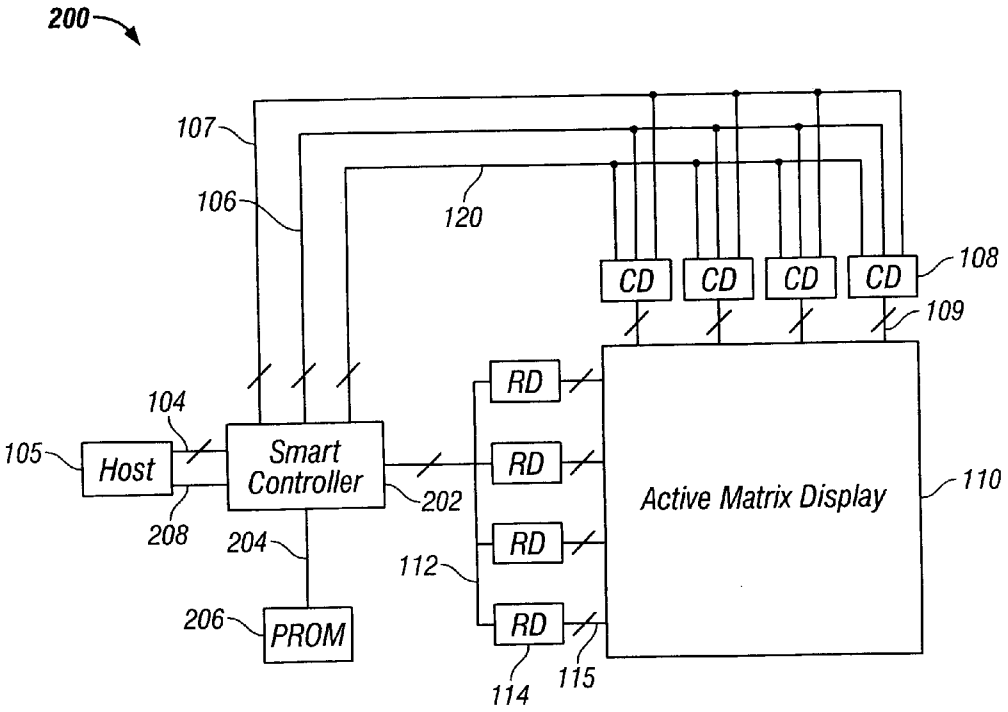

Three graphs of display gammas are shown in FIGS. 8A, 8B and 8C. A plot of transmission of a display versus the DAC value is known as the display gamma. FIG. 8A shows a linear display gamma. To get a linear display gamma, the analog reference levels are chosen to achieve linear steps in transmission as a function of the DAC value. For certain types of display images, display gammas other than linear gammas are often desirable. For example, non-linear gammas are useful for imaging work where precise control over the tonal reproduction of the image is needed in order to match print outputs. Such imaging work will be important as flat panel displays, which are more capable of a wider color gamut than cathode ray tube (CRT) displays, begin to replace CRTs on the desk top for use in desktop publishing and graphic arts. FIGS. 8B and 8C shows two non-linear display gammas for purposes of illustration.

Controlling the gamma display through the analog reference levels for the column drivers is a superior way to control the display gamma and has a big advantage over control by the color look-up table (CLUT) method. Using color look-up tables to achieve non-linear gammas results in a large number of DAC values that have the same transmission value. This is a big price to pay in flat panel displays where the DAC value is typically limited to 64 levels. Instead, by adjusting the analog reference levels, all DAC values correspond to unique transmission values. Furthermore, using the method of adjusting the analog reference levels allows the analog reference levels to be set by software in the host system 105 so that the user may adjust the display gamma depending on the application in use. Various gamma curves may also be preprogrammed into the smart controller chip (202 or 302) by the manufacturer (see curve A, curve B, etc. in FIGS. 7A and 7B), and the software in the host system may simply select between the different preprogrammed curves.

Adjusting the analog reference levels may also assist in compensating for temperature changes in the display. As temperature changes, the transfer curve for the liquid crystal (see FIG. 6) may shift to higher or lower voltages. This results in the display characteristics changing, especially for gray scale images. The smart controller (202 or 302) has the ability to compensate for such temperature changes since it can adjust the analog reference levels. An external signal input into the smart controller (202 or 302) may be used by the smart controller (202 or 302) to select between preprogrammed temperature-compensated gamma curves, or the system software in the host system 105 may change the analog reference levels.

What is claimed is:

1. A single integrated circuit device for controlling column and row drivers of an active matrix display comprising:

row control circuitry for generating digital timing and control signals which are provided to the row drivers;

column control circuitry for generating digital timing and control signals which are provided to the column drivers;

analog circuitry for generating select analog voltages and providing the select analog voltages to the column drivers for driving a plurality of column electrodes of the active matrix display, registers coupled to the analog circuitry for storing digital values which correspond with the select analog voltages which are provided to the column drivers, a multiplexer coupled to the registers for selecting between the digital values; and a digital-to-analog converter within the analog circuitry for receiving the digital value selected by the multiplexer and providing to the column drivers the select analog voltage level which corresponds with the digital value selected by the multiplexer.

2. The device of claim 1, where drive buffers, external to said single integrated circuit device, increase the power of the select analog voltages before the select analog voltages are provided to the column drivers for driving the plurality of column electrodes of the active matrix display.

3. The device of claim 1, where the select analog voltages are relatively low power and the column drivers are designed to provide relatively low power analog voltage levels to the plurality of column electrodes of the active matrix display.

4. A system for controlling column and row drivers of an active matrix display comprising:

a single integrated circuit smart controller having:

chip control circuitry for receiving digital display information and generating digital timing and control signals;

row control circuitry coupled to the chip control circuitry for receiving digital timing and control signals from the chip control circuitry and for providing row control signals to the row drivers as a function of the timing and control signals received from the chip control circuitry;

column control circuitry coupled to the chip control circuitry for receiving digital timing and control signals from the chip control circuitry and for providing column control signals to the column drivers as a function of the timing and control signals received from the chip control circuitry;

analog circuitry coupled to the chip control circuitry for generating select analog voltages and providing these select analog voltages to the column drivers as a function of the digital display information received by the chip control circuitry;

resisters coupled to the analog circuitry for storing digital values which correspond with the select analog voltages;

a multiplexer for selecting between the digital values; and a digital-to-analog converter within the analog circuitry for receiving the digital value selected by the multiplexer and providing to the column drivers the select analog voltage which corresponds with the digital value selected by the multiplexer.

5. The system of claim 4, wherein the digital values are received from a programmable read-only-memory which is coupled externally to the single integrated circuit device.

6. The system of claim 4, where the digital values are received from a host system.

7. The system of claim 6, where the digital values are determined dynamically by software in the host system in order to adjust a display gamma function for the flat panel display.

8. The system of claim 4, where the digital values are received from a flash memory which is internal to the single integrated circuit device.

9. The system of claim 4, wherein the registers store first and second digital values which correspond with first and second select analog voltage levels, the multiplexer selects between the first and second digital values, and the digital-to-analog converter within the analog circuitry receives the digital value selected by the multiplexer and provides to the column drivers the analog voltage level which corresponds with the digital value selected by the multiplexer.

10. The system of claim 9, where the first digital value is positive, the second digital value is negative, and further comprising;

a polarity signal applied to the multiplexer to switch the selection made by the multiplexer between the first and second digital values in synchronization with the timing signals provided to the column drivers, where the switching between the first and second digital values causes inversion of a liquid crystal material in the flat panel display.

11. The system of claim 4, where the digital values stored in the registers represent a plurality of display gamma functions.

12. The system of claim 4, wherein the registers include first, second, third, and fourth register files, further comprising:

a first multiplexer for selecting between a first positive digital value stored from the first register file and a second positive digital value from the second register file, where the first positive digital value relates to a first display gamma function for the flat panel display, and the second positive digital value relates to a second display gamma function for the flat panel display;

a second multiplexer for selecting between a first negative digital value from the third register file and a second negative digital value from the fourth register file, where the first negative digital value relates to the first display gamma function and the second negative digital value relates to the second display gamma function;

a third multiplexer for selecting between the digital value selected by the first multiplexer and the digital value selected by the second multiplexer and providing the selected digital value to the digital-to-analog converter within the analog circuitry for generating a select analog voltage which corresponds with the digital value selected and providing the generated select analog voltage to the column drivers for driving at least one column electrode of the active matrix display.

13. The system of claim 4, wherein the registers include first, second, third, and fourth register files, further comprising:

a first multiplexer for selecting between a first digital value from the first register file and a second digital value from the second register file;

a second multiplexer for selecting between a third digital value from the third register file and a fourth digital value from the fourth register file;

a third multiplexer for selecting between the digital value selected by the first multiplexer and the digital value selected by the second multiplexer and providing the digital value selected to the digital-to-analog converter within the analog circuitry for generating a select analog voltage which corresponds with the digital value selected;

a refresh circuit for receiving the select analog voltage and distributing the select analog voltage to either a first sample and hold circuit or a second sample and hold circuit;

a first buffer for receiving the select analog voltage from the first sample and hold circuit and providing the select analog voltage to the column drivers for driving a plurality of column electrodes of the active matrix display; and a second buffer for receiving the select analog voltage from the second sample and hold circuit and providing the select analog voltage to the column drivers for driving a plurality of column electrodes of the active matrix display.

14. The system of claim 4, wherein the registers include first, second, third, fourth, fifth, sixth, seventh, and eighth registers, further comprising;

a first multiplexer for selecting between a first positive digital value stored in the first register and a second positive digital value stored in the second register, where the first positive digital value relates to a first display gamma function for the flat panel display and the second positive digital value relates to a second display gamma function for the flat panel display;

a second multiplexer for selecting between a first negative digital value stored in the third register and a second negative digital value in the fourth register, where the first negative digital value relates to the first display gamma function and the second negative digital value relates to the second display gamma function;

a third multiplexer for selecting between a third positive digital value stored in the fifth register and a fourth positive digital value stored in the sixth register, where the third positive digital value relates to the first display gamma function and the fourth positive digital value relates to the second display gamma function;

a fourth multiplexer for selecting between a third negative digital value stored in the seventh register and a fourth negative digital value in the eighth register, where the third negative digital value relates to the first display gamma function and the fourth negative digital value relates to the second display gamma function;

a fifth multiplexer for selecting between the digital value selected by the first multiplexer and the digital value selected by the second multiplexer;

a sixth multiplexer for selecting between the digital value selected by the third multiplexer and the digital value selected by the fourth multiplexer;

a seventh multiplexer for selecting between the digital value selected by the fifth multiplexer and the digital value selected by the sixth multiplexer and providing the selected digital value to the digital-to-analog converter within the analog circuitry for generating a select analog voltage corresponding to the digital value selected;

a refresh circuit for receiving the select analog voltage and distributing the select analog voltage to either a first sample and hold circuit as a first held level or a second sample and hold circuit as a second held level;

a first buffer for receiving the first held level from the first sample and hold circuit and providing the first held level to the column drivers for driving a plurality of column electrodes of the active matrix display; and a second buffer for receiving the second held level from the second sample and hold circuit and providing the second held level to the column drivers for driving a plurality of column electrodes of the active matrix display.

15. The system of claim 4 further comprising:

data/sync input circuitry for receiving display data from an interface to a host system and providing the digital display information to the chip control circuitry.

16. A method of using a single integrated circuit device for controlling column and row drivers of an active matrix display, the method comprising:

receiving display information from an interface to a host system;

determining from the display information received a first set of digital timing and control signals for the row drivers;

determining from the display information received a second set of digital timing and control signals for the column drivers;

storing a plurality of digital values which are used to generate a corresponding plurality of select analog voltage levels;

utilizing a multiplexer to select at least one of the plurality of digital values based upon the display information received from the host system;

generating the corresponding select analog voltage level as a function of the digital value selected;

outputting the first set of digital timing and control signals to the row drivers;

outputting the second set of digital timing and control signals to the column drivers; and providing, the select analog voltage level to the column drivers.

17. The method of claim 15, further comprising:

initially receiving the plurality of digital values from a programmable read-only memory external to the integrated circuit device.

18. The method of claim 15, where the plurality of digital values are received from the interface to the host system.

19. The method of claim 18, where the plurality of digital values are determined dynamically by software in the host system.

20. The method of claim 15, wherein a first digital value in the plurality of digital values is positive and a second digital value in the plurality of digital values is negative, and further comprising:

applying a polarity signal to the multiplexer in order to alternatively select between the first digital value and the second digital value.

21. The method of claim 15, further comprising:

selecting with a first multiplexer between a first digital value and a second digital value;

selecting with a second multiplexer between a third digital value and a fourth digital value;

selecting with a third multiplexer between the digital value selected by the first multiplexer and the digital value selected by the second multiplexer;

converting the digital value selected by the third multiplexer into a select analog voltage;

distributing the select analog voltage to either a first sample and hold circuit as a first hold level or a second sample and hold circuit as a second hold level;

providing the first hold level from the first sample and hold circuit through a first buffer to the column drivers for driving a plurality of column electrodes of the active matrix display; and providing the second hold level from the second sample and hold circuit through a second buffer to the column drivers for driving a plurality of column electrodes of the active matrix display.

* * * * *

UNITED STATES PATENT AND TRADEMARK OFFICE

CERTIFICATE OF CORRECTION

PATENT NO. : 6,100,879

DATED : August 8, 2000

INVENTOR(S) :

Victor M. Da Costa

It is certified that error appears in the above-identified patent and that said Letters Patent is hereby corrected as shown below:

Bibliographic page of issued patent at [60], replace "28" with --27--.

Column 1, line 6, after the title of the invention, replace "28" with --27--

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,100,879
DATED : August 8, 2000
INVENTOR(S) : Victor M. Da Costa

It is certified that error appears in the above-identified patent and that said Letters Patent is hereby corrected as shown below:

Claim 17,
Line 16, delete "The method of claim 15" and insert -- The method of claim 16 --;

Claim 18,
Line 20, delete "The method of claim 15" and insert -- The method of claim 16 --;

Claim 20,
Line 25, delete "The method of claim 15" and insert -- The method of claim 16 --;

Claim 21,
Line 4, delete "The method of claim 15" and insert -- The method of claim 16 --;

Signed and Sealed this

Thirtieth Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,100,879
DATED : August 8, 2000
INVENTOR(S) : Da Costa

It is certified that error appears in the above-identified patent and that said Letters Patent is hereby corrected as shown below:

Delete drawing sheet 2, and substitute therefor the attached drawing sheet 2.

Signed and Sealed this

Twenty-second Day of July, 2003

JAMES E. ROGAN
*Director of the United States Patent and Trademark Office*